United States Patent [19]

Yoshii

[11] 4,392,812

[45] Jul. 12, 1983

[54] CONTROL CIRCUIT FOR GASIFIED LIQUID FUEL COMBUSTION APPARATUS

[75] Inventor: Hisao Yoshii, Sanjo, Japan

[73] Assignee: Dainichi Kogyo Co., Ltd., Shirone, Japan

[21] Appl. No.: 247,154

[22] Filed: Mar. 24, 1981

[30] Foreign Application Priority Data

Mar. 31, 1980 [JP] Japan ..... 55-43557

[51] Int. Cl.[3] ..... F23N 5/00

[52] U.S. Cl. ..... 431/73; 239/585; 251/73; 431/208

[58] Field of Search ..... 431/73, 208; 251/129, 251/132; 239/585

[56] References Cited

U.S. PATENT DOCUMENTS 3,854,695 12/1974 Baugh ..... 251/129
4,291,358 9/1981 Dettman et al. ..... 251/129

FOREIGN PATENT DOCUMENTS 49-8176 2/1974 Japan .
52-50039 11/1977 Japan .
55-54719 4/1980 Japan .

*Primary Examiner*—William E. Wayner
*Attorney, Agent, or Firm*—Joseph R. Slotnik

[57] ABSTRACT

A gasified liquid fuel combustion apparatus which includes a gasifier in which liquid fuel is heated and gasified and delivered to a burner for combustion. A nozzle provided at the outlet of the gasifier is opened and closed by a valve needle operated by a solenoid. A solenoid control circuit includes first and second rectifying circuits between a power supply and the solenoid. A normally closed switch which is opened by a timer circuit is between the power supply and the first rectifying circuit, and a voltage reducing transformer is between the power supply and the second rectifying circuit. The first and second rectifying circuits are connected to a common output line so that a high DC voltage is supplied to the solenoid when the normally closed switch is closed and a low DC voltage is supplied to the solenoid when the normally closed switch is open.

8 Claims, 5 Drawing Figures

CONTROL CIRCUIT FOR GASIFIED LIQUID FUEL COMBUSTION APPARATUS

BACKGROUND OF THE INVENTION

This invention relates to gasified liquid fuel feeding devices, and more particularly to a gasified liquid fuel feeding device operable to deliver gasified liquid fuel for mixture with air to a burner for combustion.

In combustion apparatus of the type to which the present invention relates, liquid fuel is delivered to a gasifying device where it is heated to the point of gasification. The gasified fuel is then delivered to a mixing tube where it is mixed with air and supplied to a burner. An ignition plug ignites the mixture at the burner.

Emission of the gasified fuel from the gasifier to the burner may be controlled by a discharge nozzle having a retractable valve needle cooperable therewith. In such constructions, it is known to utilize a solenoid which, when energized, retracts the valve needle and opens the nozzle. Also in such constructions, the valve needle is operated to close the nozzle by a compression spring upon deenergization of the solenoid. A typical construction of this type is disclosed in Japanese Laid-open Patent Application No. SHO 50-120040.

One of the problems in devices of this type is that soot or tar or other impurities in the liquid fuel is deposited on the nozzle and the valve needle particularly after prolonged use. This can cause the valve needle to stick to the nozzle in the closed position making it difficult to retract the valve needle and open the nozzle. Similarily, such deposits on the nozzle and the valve needle can make it difficult for the valve needle to return to the closed position upon deenergization of the solenoid.

It is necessary, therefore, that the solenoid be capable of exerting sufficient force on the valve needle to overcome the forces developed by a sticking valve needle and nozzle. It is also necessary that the solenoid be capable of overcoming the force of the compression spring which must be strong enough to cause the valve needle to close the nozzle in spite of soot or tar or impurities which may be on the valve needle or nozzle.

It will be appreciated that the force developed by a given solenoid is dependent upon its size and upon the current used to energize the solenoid. A large sized solenoid is undesirable for reasons of its dimensions, its cost, and its power consumption.

Also, the heat generated in a solenoid is a function of the current in the solenoid. Because the solenoid in gasifier devices of the type to which the present invention relates is heated by thermal conduction from the gasifier which necessarily is maintained at a high temperature, it is important that the current and resulting heat generated in the solenoid be minimized.

The present invention overcomes the aforementioned problems by providing a solenoid control circuit which is operable to provide high electric current initially for opening the nozzle, and which thereafter provides a relatively weak current which is sufficient to maintain the nozzle open.

Further objects and advantages of the invention will be set forth in part in the description which follows, and in part will be obvious from the description, or may be learned by practice of the invention. The objects and advantages of the invention may be realized and obtained by means of the instrumentalities and combinations particularly pointed out in the appended claims.

To achieve the objects and in accordance with the purposes of the invention, as embodied and described herein, this invention is directed to a gasified liquid fuel combustion apparatus in which a gasified fuel is emitted from a nozzle having a valve needle actuated by a solenoid and is mixed with combustion air and the fuel-air gaseous mixture thus obtained is supplied to a burner for combustion, comprising a power supply; a solenoid control circuit including a timer circuit adapted to operate upon closing of a power switch; a contact switch adapted to open in response to the timer circuit, a voltage reducing transformer powered from said power supply through the power switch; a first rectifying circuit and a second rectifying circuit connected to the solenoid; the first rectifying circuit receiving from the power supply through the contact switch a voltage higher than but of the same phase as the voltage supplied from the power supply to the second rectifying circuit; the second rectifying circuit receiving a lower voltage from the secondary side of the voltage reducing transformer; the first and second rectifying circuits being connected to a common output line to provide a high DC output voltage until the contact switch is opened but to provide a low DC output voltage thereafter, thereby controlling the solenoid control circuit.

In another aspect, this invention relates to a gasified liquid fuel combustion apparatus in which a gasified fuel is emitted from a nozzle having a needle valve actuated by a solenoid and is mixed with air and supplied to a burner for combustion, a control circuit for the solenoid comprising a power supply; a solenoid; a power switch; a timer circuit operable upon closing of the power switch; a normally closed contact switch connected to the timer circuit and operable to open after a predetermined time following closing of the power switch determined by the timer circuit; a voltage reducing transformer connected to the power supply when the power switch is closed; a first rectifying circuit and a second rectifying circuit, the first rectifying circuit receiving a voltage higher than but of the same phase as the voltage supplied by the power supply to the second rectifying circuit when the contact switch is closed; the second rectifying circuit receiving a lower voltage from the secondary side of the voltage reducing transformer; the first and second rectifying circuits being connected to a common line to provide a high DC output voltage to the solenoid when the contact switch is closed at a low DC output voltage to the solenoid when the contact switch is opened in response to the timer circuit.

The accompanying drawings which are incorporated in and constitute part of this specification, illustrate embodiments of this invention and, together with description, serve to explain the principle of the invention.

DESCRIPTION OF THE PREFERRED EMBODIMENTS

Figure 1:
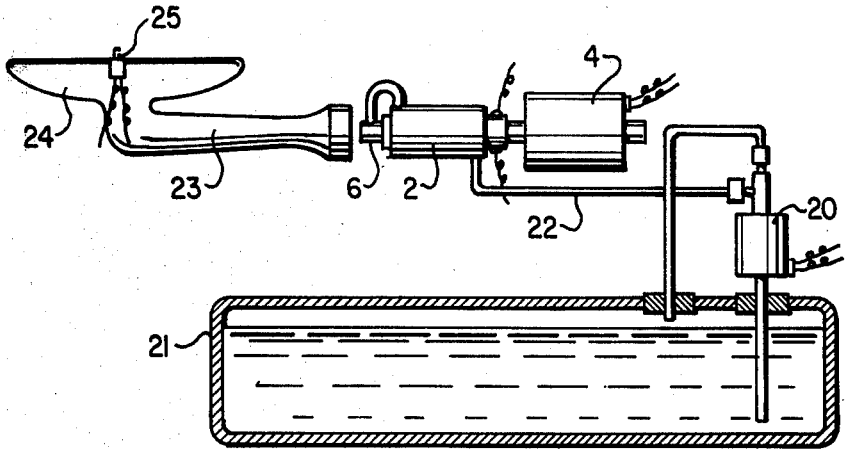
FIG. 1 is a view showing a gasifying device and combustion apparatus incorporating the present invention.
Figure 2:
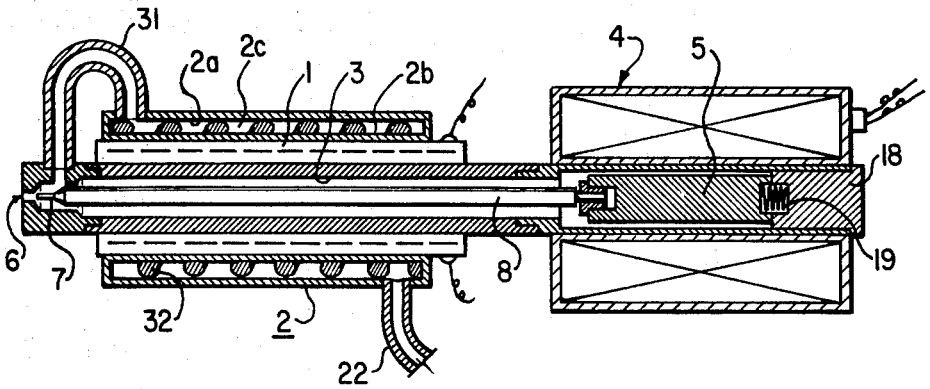
FIG. 2 is an enlarged sectional view of a portion of FIG. 1 showing the gasifying device and the valve controlling solenoid.

A gasifying liquid fuel combustion apparatus in which the present invention finds particular use is shown in FIGS. 1 and 2. As seen there, liquid fuel in a reservoir 21 is adapted to be delivered by a fuel pump 20 through a conduit 22 to a gasifier 2. As seen in FIG. 2, the gasifier 2 includes a pair of spaced concentric tubes 2*a*, 2*b* which form a chamber 2*c* therebetween. A tubular electric heater 1 is fitted inside tube 2*b*, and an inner tube 3 is fitted inside electric heater 1 and is provided at its forward end with a nozzle 6. Conduit 22 is connected to the lower rear end of the chamber 2*c* and a fuel gas pipe 31 communicates an upper forward end of chamber 2*c* with the nozzle 6. A packing 32 is arranged as a helix in the chamber 2*c*.

A solenoid 4 is mounted on the rear end of the inner tube 3 and has a movable core 5 and a fixed or attracting core 18 disposed internally thereof. A compression spring 19 is positioned between fixed core 18 and movable core 5 and normally biases the latter in a left-hand direction as seen in FIG. 2.

A valve rod 8 is connected to the movable core 5 and is slidable within the inner tube 3. The valve rod 8 is formed at its forward end with a valve needle 7 for opening and closing the nozzle 6. A mixing pipe 23 is positioned to receive gasified fuel from the nozzle 6 and is connected to a burner 24. An ignition plug 25 is provided on the burner 24 for igniting a mixture of gasified fuel and air.

In use, the gasifier 2 is heated by supplying electric current to the heater 1. Liquid fuel delivered by the fuel pump 20 through conduit 22 to the gasifier 2 passes through the chamber 2*c*. The liquid fuel is heated as it passes through the gasifier 2 and is delivered in gasified form through the fuel gas pipe 31 to the nozzle 6.

In accordance with the invention, a solenoid control circuit is provided for controlling operation of the solenoid 4 so that the valve needle 7 can be retracted from the nozzle 6 against the holding force of soot, tar, or other foreign matter accumulated on the nozzle 6 and valve needle 7, and so that heating induced in the solenoid by current therein is minimized. Also, the solenoid control circuit of the present invention obviates the need for a large solenoid to develop the necessary force to operate the valve needle 7.

As embodied herein, a solenoid control circuit 17 includes a timer circuit 9 which is operable upon closing a power switch 27 and an ignition switch 28 to connect a power supply 26 to the timer circuit 9. Closing of the power switch 27 also connects the power supply 26 with the electric heater 1. After the electric heater 1 is sufficiently preheated for operation of the gasifier 2, the ignition switch 28 is closed. This also energizes the fuel pump 20 to supply fuel from the reservoir 21 to the gasifier 2, and energizes a high voltage ignition transformer 29 which powers the high voltage ignition plug 25.

In accordance with the present invention, the solenoid control circuit includes a first rectifying circuit and a second rectifying circuit. A normally closed contact switch is between the power supply and the first rectifying circuit, and a voltage reducing transformer is between the power supply and the second rectifying circuit. The first rectifying circuit receives a voltage higher than but of the same phase as the voltage supplied from the power supply to the second rectifying circuit when the contact switch is closed. The second rectifying circuit receives a lower voltage from the secondary side of the voltage reducing transformer.

As embodied herein, solenoid control circuit 17 includes a voltage reducing transformer 10 and rectifiers 11, 12, 13, 14, 15 and 16. Rectifiers 11, 12, 13, and 14 make up a first rectifying circuit which connect the power supply 26 to the solenoid 4. A normally closed contact switch 30 is between the power supply 26 and the first rectifying circuit. The timer circuit 9 is operable to open the contact switch 30 after a predetermined time following closing of the power switch 27 and the ignition switch 28.

Rectifiers 13, 14, 15, and 16 make up a second rectifying circuit which connects power supply 26 to solenoid 4. The voltage reducing transformer 10 is between the power supply and the second rectifying circuit.

In use, the power switch 27 is closed thereby energizing the electric heater 1. Upon completion of preheating of the electric heater 1, the ignition switch 28 is closed. During the initial stage, contact switch 30 remains closed and the solenoid 4 is energized by the power supply 26 through the first rectifying circuit 11, 12, 13, and 14. This causes the movable core 5 to be attracted toward the stationary core 18 which causes the valve needle 7 to be withdrawn from the nozzle 6 and the nozzle 6 to be opened. At the same time that the ignition switch 28 is closed, the fuel pump 20 is energized to supply fuel from the reservoir 21 to the gasifier 2 where it is heated and gasified and emitted from the nozzle 6. The gasified fuel travels through the mixing tube 23, is mixed with air, and the mixture is ignited by the ignition plug 25 in the burner 24.

Subsequently, the contact switch 30 is opened by operation of the timer circuit 9. Now, voltage from the power supply 26 is supplied to the solenoid unit 4 through the secondary side of the transformer 10 and the second rectifying circuit 13, 14, 15 and 16. This lower voltage is sufficient to maintain the nozzle 6 in the open state.

It will be appreciated that a strong force of attraction is required to draw the movable core 5 toward the fixed core 18 because of tar or soot deposits on the valve needle 7 or in the nozzle 6, and because of the force required to compress the spring 19. However, once the movable core 5 moves into engagement with fixed core 18, the force required to maintain the cores in engagement is substantially less. It has been found that the force required to maintain the solenoid cores in engagement is equal to approximately 10 to 20 percent of the attracting force initially required. Therefore, high voltage need only be supplied to the solenoid during a short initial period and this voltage can thereafter be reduced to a value sufficient only to maintain the cores 5, 18 in engagement.

When it is desired to terminate combustion, it is only necessary to open the power switch 27. The solenoid unit 4 is then deactivated so that the spring 19 causes the valve needle 7 to close the nozzle 6. Also, the fuel pump 20 is simultaneously deactivated and interrupts the supply of fuel to the gasifier 2.

Figure 3:
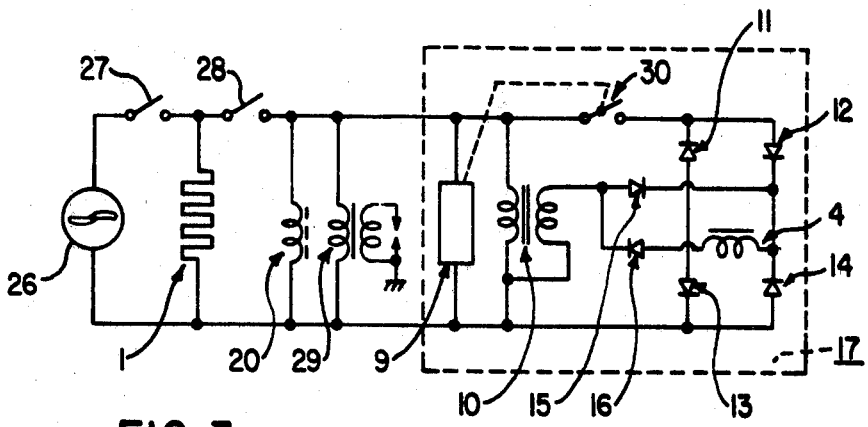
FIG. 3 is a circuit diagram showing a preferred form of solenoid control circuit incorporating the present invention.

As shown in FIG. 3, the first rectifying circuit 11, 12, 13, 14 alone supplies voltage from the power supply 26 to the solenoid unit 4 when the contact switch 30 is closed because the rectifier 15, 16 of the second rectifying circuit are inversely biased and the voltage in the first and second rectifier circuits are of the same phase. This prohibits power supply to the solenoid 4 from the voltage reducing transformer when the contact switch 30 is closed. However, when the timer circuit 9 opens the contact switch 30, rectifier 15, 16 are forwardly biased and the lower voltage from the voltage reducing transformer 10 is supplied through the second rectifying circuit to the solenoid 4. In this manner, the voltage switchover from the first rectifying circuit to the second rectifying circuit is achieved without interruption of the voltage supply thereby enabling retention of the attracted state of the solenoid cores 5, 18. Importantly, since the rectifiers 13, 14 are used in both circuits, the secondary coil and the primary coil of the voltage reducing transformer 10, which can be a single coil transformer, are connected at one end to a common line.

Figure 4:
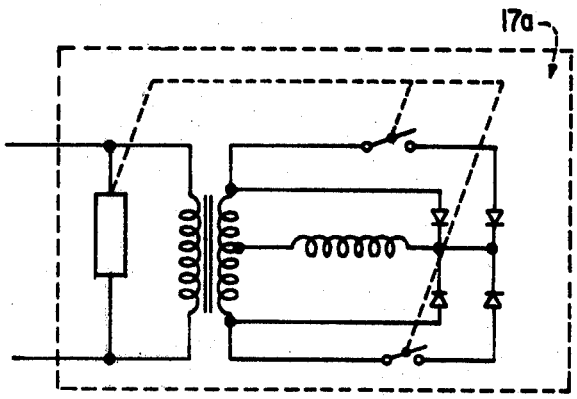
FIG. 4 is a view similar to FIG. 3 showing a modified solenoid control circuit employing a full-wave rectifying circuit.
Figure 5:
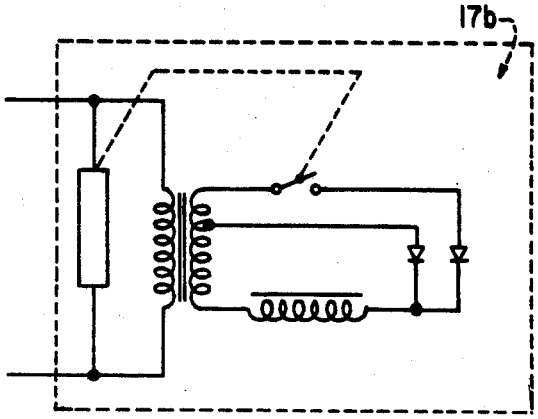
FIG. 5 is a view similar to FIGS. 3 and 4 and showing a still further modified solenoid control circuit employing a half-wave rectifying circuit.

FIGS. 4 and 5 show other embodiments of solenoid control circuits according to the present invention. FIG. 4 shows a full-wave rectifying circuit and FIG. 5 shows a half-wave rectifying circuit.

It will be apparent to those skilled in the art that various additions, substitutions, modifications and omissions can be made to the device of the present invention without departing from the scope or spirit of the invention. Thus, it is intended that the present invention cover the additions, substitutions, modifications, and omissions of this invention provided they come within the scope of the appended claims and there equivalents.

What is claimed is:

1. A gasified liquid fuel combustion apparatus in which a gasified fuel is emitted from a nozzle having a valve needle actuated by a solenoid and is mixed with combustion air and the fuel-air gaseous mixture thus obtained is supplied to a burner for combustion, comprising a power supply; a solenoid control circuit including a timer circuit adapted to operate upon closing of a power switch; a contact switch adapted to open in response to said timer circuit; a voltage reducing transformer powered from said power supply through said power switch; a first rectifying circuit and a second rectifying circuit connected to said solenoid; said first rectifying circuit receiving from said power supply through said contact switch a voltage higher than but of the same phase as the voltage supplied from said power supply to said second rectifying circuit; said second rectifying circuit receiving a lower voltage from the secondary side of said voltage reducing transformer; said first and second rectifying circuits being connected to a common output line to provide a high DC output voltage until said contact switch is opened but to provide a low DC output voltage thereafter, thereby controlling said solenoid through said solenoid control circuit.

2. An apparatus according to claim 1, wherein each of said first and rectifying circuits includes a full-wave rectifying circuit having four rectifying elements.

3. An apparatus according to claim 2, wherein said first and second full-wave rectifying circuits are so structured as to have two rectifying elements connected thereto in common for said two circuits.

4. An apparatus according to claim 1, wherein each of said first and second rectifying circuits includes a full-wave rectifying circuit having two rectifying elements.

5. An apparatus according to claim 1, wherein said first and second rectifying circuits each includes a half-wave rectifying circuit having one rectifying element.

6. An apparatus according to claim 1, wherein the input line to said first rectifying circuit of high voltage is opened upon opening said contact switch and the input line to said second rectifying circuit of lower voltage is continuously connected to said power supply.

7. In a gasified liquid fuel combustion apparatus in which a gasified fuel is emitted from a nozzle having a valve needle actuated by a solenoid and is mixed with air and supplied to a burner for combustion, a control circuit for said solenoid comprising a power supply; a solenoid; a power switch; a first rectifying circuit and a second rectifying circuit connecting the power supply to said solenoid; a normally closed contact switch between said power supply and said first rectifying circuit; a timer circuit operable upon closing of said power switch, said timer switch operable to open said contact switch after a predetermined time following closing of said power switch; a voltage reducing transformer between said power supply and said second rectifying circuit; said first rectifying circuit receiving a voltage higher than but of the same phase as the voltage supplied by said power supply to said second rectifying circuit when said contact switch is closed; said second rectifying circuit receiving a lower voltage from the secondary side of said voltage reducing transformer; said first and second rectifying circuits being connected to a common output line to provide a high DC output voltage to said solenoid when said contact switch is closed and a low DC output voltage to said solenoid when said contact switch is opened in response to said timer circuit, thereby controlling said solenoid through said solenoid control circuit.

8. A control circuit as claimed in claim 7 wherein the voltage supplied by said power supply to said solenoid through said second rectifying circuit in from about 10% to about 20% of the voltage through said first rectifying circuit.

* * * * *

UNITED STATES PATENT AND TRADEMARK OFFICE

CERTIFICATE OF CORRECTION

PATENT NO. : 4,392,812

DATED : July 12, 1983

INVENTOR(S) : HISAO YOSHII

It is certified that error appears in the above-identified patent and that said Letters Patent are hereby corrected as shown below:

Column 6, Line 31, change "switch" (second occurrence) to -- circuit --.

Signed and Sealed this

*Twenty-second* Day of *November 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,392,812

DATED : July 12, 1983

INVENTOR(S) : HISAO YOSHII

It is certified that error appears in the above-identified patent and that said Letters Patent are hereby corrected as shown below:

Figure 4 should appear as shown below:

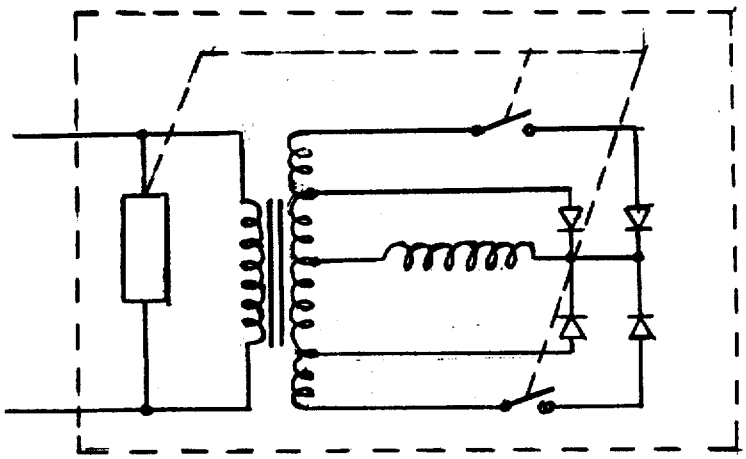

FIG. 4

Signed and Sealed this

Eighth Day of May 1984

[SEAL]

Attest:

GERALD J. MOSSINGHOFF

Attesting Officer

Commissioner of Patents and Trademarks